US006296993B1

(12) United States Patent
Sowinski et al.

(10) Patent No.: US 6,296,993 B1
(45) Date of Patent: Oct. 2, 2001

(54) METHOD OF PROVIDING DIGITIZED PHOTOGRAPHIC IMAGE

(75) Inventors: Allan F. Sowinski; Richard P. Szajewski, both of Rochester, NY (US); Nigel R. Wildman, Watford Hertfordshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/593,089

(22) Filed: Jun. 13, 2000

(51) Int. Cl.[7] ..... G03C 5/40
(52) U.S. Cl. ..... 430/404
(58) Field of Search ..... 430/404

(56) References Cited

U.S. PATENT DOCUMENTS

| | | | | |
|---|---|---|---|---|
| 2,558,857 | | 7/1951 | Land | 430/208 |
| 3,179,517 | | 4/1965 | Tregillus et al. | 430/206 |
| 3,419,006 | | 12/1968 | King | 128/268 |
| 3,615,482 | | 10/1971 | Cronig | 430/456 |
| 3,664,343 | | 5/1972 | Assarsson | 128/284 |
| 3,907,563 | | 9/1975 | Land | 430/206 |
| 3,993,551 | | 11/1976 | Assarsson et al. | 204/159.14 |
| 4,480,025 | * | 10/1984 | Chang et al. | 430/404 |
| 4,605,608 | | 8/1986 | Bullittt | 430/206 |
| 5,028,339 | | 7/1991 | Clark, III | 210/688 |
| 5,115,801 | | 5/1992 | Cartmell et al. | 602/48 |
| 5,378,542 | | 1/1995 | Hanzalik et al. | 428/483 |
| 5,422,233 | * | 6/1995 | Eckert et al. | 430/404 |
| 5,453,804 | | 9/1995 | Norris et al. | 354/83 |
| 5,465,155 | | 11/1995 | Edgar | 358/500 |
| 5,478,703 | * | 12/1995 | Simons | 430/404 |
| 5,519,510 | | 5/1996 | Edgar | 358/471 |
| 5,695,916 | * | 12/1997 | Fyson | 430/404 |
| 5,698,379 | | 12/1997 | Bohan et al. | 430/359 |
| 5,714,159 | | 2/1998 | Shalaby | 424/426 |
| 5,790,277 | | 8/1998 | Edgar | 358/487 |
| 5,792,471 | | 8/1998 | Curatolo | 424/480 |
| 5,840,471 | | 11/1998 | Fukuwatari et al. | 430/399 |
| 5,988,896 | | 11/1999 | Edgar | 396/604 |
| 6,017,688 | | 1/2000 | Edgar | 430/470 |
| 6,183,933 | * | 2/2001 | Ishikawa et al. | 430/404 |

FOREIGN PATENT DOCUMENTS

1121277 * 7/1968 (GB) .

* cited by examiner

*Primary Examiner*—Hoa Van Le
(74) *Attorney, Agent, or Firm*—J. Lanny Tucker

(57) ABSTRACT

Image formation in photosensitive silver halide materials can be simplified by photoprocessing the imagewise exposed materials using photochemical delivery articles that consist essential of a nonporous substrate and a hydrogel that contains the one or more photochemicals needed for image formation. The delivery articles can be laminated or otherwise contacted with the imagewise exposed materials on the silver halide emulsion side allowing photochemicals to diffuse into and out of the materials for the desired photochemical reactions. Multiple delivery articles can be used in sequence to provide the desired sequence of photochemical reactions. Resulting images at any stage of processing can be digitized by scanning and the images can be stored, printed, displayed or transmitted electronically for a number of useful purposes.

30 Claims, No Drawings

METHOD OF PROVIDING DIGITIZED PHOTOGRAPHIC IMAGE

FIELD OF THE INVENTION

This invention relates to a method of providing a digitized photographic image using a photochemical delivery article comprising a hydrogel containing photographic processing chemicals for photoprocessing and digitizing the resulting image. This invention can be used to provide a digitized color or black-and-white photographic image.

BACKGROUND OF THE INVENTION

The basic image-forming process of photography comprises the exposure of a silver halide photographic recording material, such as a color film, to electromagnetic radiation, and the chemical processing of the exposed material to provide a useful image. Chemical processing involves one fundamental step and one or more ancillary steps. The fundamental step is treatment of the exposed silver halide material with a developing agent wherein some or all silver ion is reduced to metallic silver, and in the case of color materials, a dye image is formed (because of a color developing agent).

For color materials, the ancillary steps include the removal of silver metal and silver salts by one or more steps of bleaching and fixing so that only a dye image remains in the processed material. These steps are commonly used to enable optical printing and to make scanning easier. During bleaching, the developed silver is oxidized to a silver salt by a suitable bleaching agent. The oxidized silver is then dissolved and removed from the material using a "fixing" agent or silver solvent in a fixing step. Black-and-white materials are desilvered using only the fixing step.

Additional photoprocessing steps may be needed including rinsing or dye stabilization that requires even more photoprocessing chemicals. In the case of color reversal materials, additional photoprocessing steps include black-and-white development, a reversal step, pre-bleaching or conditioning step and one or more rinsing steps.

All of these photoprocessing steps require preparation of the photoprocessing compositions (whether in aqueous or solid form), large or small photoprocessing tanks or reservoirs to hold the compositions, and disposal or regeneration of the "spent" compositions once a predetermined amount of exposed material has been processed. All of these operations require considerable manufacturing effort, shipping and handling of chemicals and aqueous solutions, replenishment of the solutions, and disposal of solutions into the environment. These characteristics of conventional photoprocessing are labor intensive, tedious, costly and potentially harmfull to the environment (although much work has been accomplished in the industry to make the compositions more environmentally "friendly").

New business opportunities are thought to exist if ways can be found to minimize or obviate the problems described above. Providing photographic images (often known as "photofinishing") is a growing business and yet there is a need to provide those images in ways that do not require some or all of the traditional photoprocessing solutions, equipment and replenishment systems.

Various research efforts have been carried out in the industry to provide new methods of imaging. For example, research has been carried out directed at putting photoprocessing chemicals directly into the imageable materials. Coated donor/receivers systems on flexible supports have been developed in recent decades for output media (such as color prints). The conventional "instant" photographic materials are examples of imaging materials that include coated and/or delivered photoprocessing chemicals. See for example, U.S. Pat. No. 4,605,608 (Bullitt).

U.S. Pat. No. 5,453,804 (Norris et al) describes a hydrogel, rolled flexible carried material that comprises an aqueous, alkaline processing composition that is used in an image transfer processing method. This material does not include a backing sheet or non-porous supporting substrate.

All of the ongoing research efforts still have some unattractive features pertaining to the delivery of the photoprocessing chemicals (identified as "photochemicals" hereinafter). To date, the need for enabling technology remains unsatisfied.

Recent digital technologies in the photographic industry offer advantages in that they can enable the user to manipulate the images after photochemical processing by scanning to create a digital representation of the image. One of these advantages is the ability to readjust the exposure by automatic tone scaling to correct for either over- or underexposure. Other uses of digitization are to crop, enlarge or otherwise modify the image, or to send the image to other users electronically for various purposes. The growing awareness of digitization of photographic images provides almost limitless possibilities for image manipulation for various purposes in a number of industries.

Thus, there is a need for simplified photoprocessing methods that include the possibility of digitization of the resulting images.

SUMMARY OF THE INVENTION

The problems noted above can be overcome with a method of providing an image in an imagewise exposed photographic silver halide material comprising at least one silver halide emulsion layer, the method comprising:

A) contacting a photochemical delivery article with a silver halide emulsion layer of the imagewise exposed photographic silver halide material to bring them into reactive association to form a laminate for a sufficient time to cause to a photochemical reaction and to provide a photographic image, the photochemical delivery article consisting essentially of a nonporous substrate having disposed thereon a hydrogel containing one or more diffusible photochemicals, and B) scanning the photographic image formed in step A to form density representative electronic signals.

This method can be further extended by digitally manipulating the density representative electronic signals formed in B noted above to provide a digital record.

The present invention avoids the need for high precision fluid spreading required for extrusion hopper metering. It also avoids the traditional processing baths and equipment used in conventional photoprocessing and all the problems they entail.

These advantages are provided with a photochemical delivery article that can be laminated to imagewise exposed photographic silver halide materials to deliver photochemicals for image formation. This lamination operation allows photochemicals to move into and out of the imagewise exposed photographic materials for a period of time sufficient for the desired photochemical reaction(s) to occur. Once the method is finished, the contacted material needs little or no further handling. In one embodiment, drying is unnecessary before the processed material is scanned to provide density representative electronic signals in the digitization of the image.

The photochemical delivery article is a permeable matrix composed of a hydrogel that has been impregnated or swollen with one or more photochemicals prior to use. The article can be used to deliver the photochemicals in a controlled fashion to the same or different materials without additional fluid extrusion, pumping or dipping the materials into processing baths. Different delivery articles can be used in sequence to deliver the different photochemicals necessary for the various sequential photochemical reactions required for providing a color or black-and-white image. For example, in providing color negative images, one delivery article could be used to deliver a color developing agent and one or more other delivery articles could be used thereafter to desilver the material. Following all desired processing steps, the processing material can be used to provide digitized images (or a digital record) for storing, transmitting, printing, displaying or other manipulation.

The hydrogel containing delivery articles useful in this invention are advantageous because they readily absorb solvents (containing needed photochemicals), undergo rapid swelling without discemable dissolution and maintain three-dimensional networks capable of reversible deformation while maintaining their physical and mechanical integrity. Thus, photochemicals can be imbibed into the matrices with minimal effort, and they can be readily absorbed into the imaged materials in the same manner.

The simplified processing techniques described herein as especially suitable for digitization of the images obtained thereby. Not only are various digital manipulations possible, including cropping, enlargements, "red-eye" removal and suppression of defects from scratches or dust, but the digital signal can be stored in any suitable electronic storage medium or transmitted to other sites. In addition, the images can be modified to correct tone, compensate for over- or under-exposure or to provide color adjustments using conventional algorithms without any loss in information.

The photochemical delivery article useful in this invention is described and claimed in copending and commonly assigned U.S. Ser. No. 09/593,097 filed on even date herewith by Sowinski, Szajewski and Wildman.

Both the delivery article described and claimed in the just described copending application and the method of this invention can be used with processing apparatus described and claimed in copending and commonly assigned U.S. Ser. No. 09/592,815 filed on even date herewith by Szajewski, Sowinski and Wildman.

DETAILED DESCRIPTION OF THE INVENTION

The photochemical delivery article useful in this invention contains only two essential structural components: a nonporous substrate and a hydrogel disposed thereon. The diffusible photochemicals (described below) are incorporated within the hydrogel. Thus, there is no image-receiving or image-donating material or layer in the delivery articles used in this invention, in contrast to the materials described in U.S. Pat. No. 4,605,608 (noted above).

The nonporous substrate serves to provide some physical and mechanical integrity to the delivery article, and can be also considered a "backing sheet", support or release liner. It is preferred that the nonporous substrate be dimensionally stable, but remain flexible and deformable, allowing easy storage in roll form. Conventional photographic film supports and hydrogel wound dressing backing sheets are examples of useful support materials that have a desirable blend of plasticity and dimensional stability.

In one contemplated embodiment, the nonporous substrate is bonded to the hydrogel and is not releasable from it without force. This arrangement allows easy separation of the hydrogel from a laminate with a processed photographic material following the processing step. Alternatively, a removable substrate can be separated from the hydrogel to provide access to the top surface of the hydrogel-photographic material laminate to allow application of additional fluids, processing solutions or activator solutions.

The substrate should be as thin as possible, for example, generally less than 500 $\mu$m and preferably less than 200 $\mu$m. The minimum thickness would depend upon the type of material composing the substrate but generally it is at least 75 $\mu$m. The substrate is nonporous so the photochemicals more readily diffuse into the photographic material. In other words, the substrate acts as a fluid barrier and is therefore substantially fluid impermeable.

The substrate further serves to prevent the hydrogel from adhering to itself. The photochemical delivery article can be stored and used as sheets or strips. Preferably, it can be stored and used in roll form, and it is even more important that the hydrogel not adhere to itself in that form. In addition, the substrate would provide additional advantages of a barrier material to reduce air permeation or dehydration.

The substrate can be transparent and colorless, tinted or opaque to light depending upon the particular use of the photochemical delivery article.

The substrates can be homogeneous (same composition throughout) or heterogeneous (varying composition) and can be composed of synthetic or naturally-occuring polymeric materials, metal foils or flexible ceramics. Examples of useful substrate materials include, but are not limited to, resin-coated papers, polyethylenes, polypropylenes, polyethylenepolypropylenes, polyvinylidene chloride, polyamides, polyesters (such as polyethylene terephthalate and polyethylene naphthalate), polyvinyl chloride, cellulosic polymers (such as cellulose triacetate), polyurethanes, polyvinyl alcohol, silicone rubbers, polyvinyl (meth)acrylates, polystyrenes and others too numerous to mention. Other useful substrate materials are those used in conventional photographic materials as described for example in *Research Disclosure*, publication 38957, pages 592–639 (September 1996) Section XV Supports. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011).

Preferred substrate materials are polyvinyl (meth) acrylates, polyethylene and polypropylene films and resin-coated papers. In reference to polymers herein, it is intended to include homopolymers as well as copolymers containing recurring units from two or more different polymerizable monomers or segments (in the case of block copolymers).

In general, hydrogels, or water-containing gels, are porous matrices of polymers characterized by hydrophilicity and insolubility in water. In water, they swell to an equilibrium volume but maintain their shape. The hydrophilicity is usually due to the presence of water-solubilizing groups such as hydroxy, carboxy, carbonamido, sulfo and others readily apparent to one skilled in the art attached to the hydrogel polymers. Hydrogel water-insolubility and stability of shape are due to the presence of a three-dimensional network. The swollen state results from a balance between the fluid dispersing forces acting on hydrated chains and cohesive forces that do not prevent the penetration of water into the network. Cohesive forces can be provided by crosslinking. Other forces are electrostatic, hydrophobic or dipole-dipole forces. Further details of hydrogels and their classifications are provided by Kudela in *Encyclopedia of Polymer Science and Engineering*, Volume 7, John Wiley & Sons (New York, 1987), pp. 783–807.

Hydrogels are well known in the medical literature as wound and burn dressings, articles for chemical or drug delivery, conductive articles for electrocardiography, electrophoretic devices and tissue-compatible surgical fillers. We have discovered that some commercial articles used for wound or burn dressings are useful for making rudimentary photochemical delivery articles. Hydrogels known in the art are described for example in U.S. Pat. No. 3,419,006 (King), U.S. Pat. No. 3,664,343 (Assarsson), U.S. Pat. No. 3,993,551 (Assarsson et al), U.S. Pat. No. 5,714,159 (Shalaby), U.S. Pat. No. 5,792,471 (Curatolo), U.S. Pat. No. 4,909,244 (Quarfoot et al) and U.S. Pat. No. 5,115,801 (Cartnell et al), all incorporated herein by reference for their teaching of hydrogels and methods of manufacture. Some of the details of hydrogels are presented herein for illustrative purposes, but it should be understood that the invention is not so limited.

Thus, useful hydrogels can be composed of polymethacrylic esters or polyacrylic esters, polymers derived from hydroxyalkyl methacrylates or acrylates, polyacrylamides or polymethacrylamides with ionic comonomer units, N-vinyl-2-pyrrolidinone copolymers containing less hydrophilic comonomer units or ionizable groups, polymers containing oxyethylene or oxypropylene units (for example polyoxyethylenes, polyoxypropylenes and polyoxyethylene-polypropylenes as described for example in U.S. Pat. No. 3,419,006 and U.S. Pat. No. 3,664,343) and crosslinked methoxypoly(ethylene glycols). Preferred hydrogels are composed of polymers comprising oxyethylene or polyoxypropylene units or both, and the most preferred hydrogels are composed of polyoxyethylenes.

For example, one useful hydrogel material is derived from the polymerization of poly(ethylene oxide) resin to provide a final weight of 4% PEO resin and 96% water. Such a material is commercially available as 2nd Skin™ Moist Burn Pad burn dressing from Spenco Medical Products. This material has both a backing sheet (substrate) and a cover sheet (on the opposite side of the hydrogel). Another commercially available hydrogel is Vigilon™ wound dressing that is marketed by Bard Medical Division of C.R. Bard Inc. This material appears to be composed of 4% PEO also and has a polyethylene backing sheet on both sides. Of course, at least one of the backing sheets must be removed so the resulting delivery article can imbibe photochemicals and be applied to a processable photographic material.

Preferably, the hydrogel matrix is substantially free of gelatin, gelatin derivatives or other hydrophilic colloidal materials that are commonly used in photographic emulsion layers. Thus, the delivery articles useful this invention are different in composition from the processing web described in U.S. Pat. No. 3,179,517 (noted above). In addition, at noted above, the delivery articles useful in this invention are not "image-donating" or "image-receiving" webs that are generally used in diffusion transfer materials.

The hydrogels can be disposed on the substrates in any suitable fashion. For example, they can be polymerized and cast onto the substrate from the polymerization solution. Alternatively, the hydrogel can be impregnated onto a suitable absorbing, reinforcing material such as a reticulated foam, scrim, or non-woven material and then laminated to the substrate. The substrate is preferably a dimensionally stable backing support. The reinforcing material may be bonded to the dimensionally stable support by means of an adhesive layer or other means prior to impregnation with the hydrogel, or the hydrogel itself may be directly bonded to the support during the casting process or by means of an adhesive.

The various photochemicals necessary to provide a photographic image are imbibed into or contacted with the hydrogels to provide the photochemical delivery articles of the invention. Alternatively, the hydrogel matrix can be dried to remove non-chemically bound water to accelerate the uptake of photochemical processing composition upon immersion or direct application. One skilled in the art would readily understand how long the hydrogel needs to be soaked with the photochemical solutions to imbibe the necessary amount of photochemicals. It may vary with the type and amount of photochemicals desired for a given photochemical reaction. The various photochemical solutions are prepared or purchased as described below using the various photochemicals known in the art or from several commercial sources.

In one embodiment, a photochemical released from the photochemical delivery article is a chemical acid or a base. Blocked forms of various photographic reagents can be contained in the photographic material itself, such as a blocked developer that is released upon contact with base. Upon bringing a chemical base-containing delivery article into reactive association with a silver halide emulsion of such an imagewise exposed photographic material, the chemical base causes the blocked developer to be released and development to occur. A useful chemical base in this instance would be an aqueous inorganic base, such as an alkali metal hydroxide (for example sodium hydroxide). It is preferred to deliver smaller molecules or ions with the photochemical delivery article in order to increase the rate of diffusion and thereby accelerate photochemical delivery and reaction.

It is appreciated that the hydrogel moisture content, polymer content, crosslinking density, thickness and structural strength can be modified to advantage to suit the processing method of this invention for a given photographic material to be processed. The photochemical delivery article should have a hydrogel layer thickness of at least 0.01 mm in order to contain adequate quantities of deliverable photochemical(s) and a thickness of greater than about 0.5 mm is preferred. There is no upper limit on the thickness of the hydrogel layer of the photochemical delivery article, but it is preferred that it be less than about 5 mm. A reinforcing material, if used, can have a matrix or honeycomb structure, random fibers or a fine netting to minimize barriers to solution flow or to make processing more uniform. It is preferred to avoid the use of a reinforcing material in order to minimize barriers to diffusion of photochemical (s).

Lubricants, surfactants, wetting agents or other surface active agents may be included in the hydrogel to improve wetting or swelling of the image photographic materials, photochemical delivery, and lamination and delamination during processing.

Black-and-White Image Formation

A black-and-white image can be obtained according to the present invention using the basic photoprocessing steps of black-and-white development and fixing wherein each processing step is carried out using a separate delivery article. Thus, one delivery article would be used for black-and-white development and a second delivery article for fixing, each delivery article containing a black-and-white photochemical (for example, a black-and-white developing agent).

For black-and-white image formation, the essential photochemicals that are needed to cause the necessary photochemical reactions are black-and-white developing agents and fixing agents. These and other photochemicals commonly used in black-and-white processing are described below in some detail.

Imaged black-and-white materials that can be processed using the present invention can include black-and-white silver halide radiographic films, aerial films, black-and-white motion picture films, duplicating and copy films, and amateur and professional continuous tone black-and-white films and papers. The general composition of such materials is well known in the art.

For example, a black-and-white developing composition can be prepared and imbibed into a hydrogel. This composition can contain one or more black-and-white dihydroxybenzene developing agents, including hydroquinone and derivatives thereof that would be readily apparent to those skilled in the art (see for example, U.S. Pat. No. 4,269,929 of Nothnagle and U.S. Pat. No. 5,457,011 of Lehr et al). Mixtures of these developing agents can be used if desired.

Other useful developing agents include ascorbic acid and its derivatives are described in a considerable number of publications relating to photographic processes, including U.S. Pat. No. 5,236,816 (Purol et al) and references cited therein. Useful ascorbic acid developing agents include ascorbic acid and the analogues, isomers and derivatives thereof Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al), EP-A-0 585,792 (published Mar. 9, 1994), EP-A-0 573 700 (published Dec. 15, 1993), EP-A-0 588 408 (published Mar. 23, 1994), WO 95/00881 (published Jan. 5, 1995), U.S. Pat. No. 5,089,819 and U.S. Pat. No. 5,278,035 (both of Knapp), U.S. Pat. No. 5,384,232 (Bishop et al), U.S. Pat. No. 5,376,510 (Parker et al), Japanese Kokai 7-56286 (published Mar. 3, 1995), U.S. Pat. No. 2,688,549 (James et al), U.S. Pat. No. 5,236,816 (noted above) and *Research Disclosure*, publication 37152, March 1995. D-, L-, or D,L-ascorbic acid (and alkali metal salts thereof) or isoascorbic acid (or alkali metal salts thereof) are preferred. Mixtures of these developing agents can be used if desired.

The black-and-white developing composition also can include one or more auxiliary co-developing agents that are also well known (for example, Mason, *Photographic Processing Chemistry*, Focal Press, London, 1975). Any auxiliary developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-hydroxymethyl-4-methyl-1-phenyl-3-pyrazolidone, 5-phenyl-3-pyrazolidone, 1-p-aminophenyl-4,4-dimethyl-3-pyrazolidone, 1-p-tolyl-4,4-dimethyl-3-pyrazolidone, 1-p-tolyl-4-hydroxymethyl-4-methyl-3-pyrazolidone, and 1-phenyl4,4-dihydroxymethyl-3-pyrazolidone. Other useful auxiliary co-developing agents comprise one or more solubilizing groups, such as sulfo, carboxy or hydroxy groups attached to aliphatic chains or aromatic rings, and preferably attached to the hydroxymethyl function of a pyrazolidone, as described for example, in U.S. Pat. No. 5,837,434 (Roussihle et al). A most preferred auxiliary co-developing agent is 4-hydroxymethyl-4-methyl-1-phenyl-3-pyrazolidone.

Less preferred auxiliary co-developing agents include aminophenols such as p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(β-hydroxyethyl)-p-aminophenol. A mixture of different types of auxiliary developing agents can also be used if desired.

An organic antifoggant is preferably present in the black-and-white developing composition, either singly or in admixture. Such compounds control the gross fog appearance in the processed elements. Suitable antifoggants include, but are not limited to, benzimidazoles, benzotriazoles, mercaptotetrazoles, indazoles and mercaptothiadiazoles. Representative antifoggants include 5-nitroindazole, 5-p-nitrobenzoylaminoimidazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazol-2-thiol, 5-methylbenzotriazole, benzotriazole and 1-phenyl-5-mercaptotetrazole. Benzotriazole is most preferred.

The developing composition can also include one or more preservatives or antioxidants. Various conventional black-and-white preservatives can be used including sulfites. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Mixtures of these materials can also be used.

Examples of preferred sulfites include sodium sulfite, potassium sulfite, lithium sulfite, sodium bisulfite, potassium bisulfite, sodium metabisulfite, potassium metabisulfite, and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

Various known buffers, such as borates, carbonates and phosphates, can be included in the composition to maintain the desired pH. The pH can be adjusted with a suitable base (such as a hydroxide) or acid. The pH of the developing/fixing composition is generally from about 9 to about 12, and more preferably from about 10 to about 11.

The black-and-white developing composition can contain one or more sequestering agents that typically function to form stable complexes with free metal ions (such as silver ions) in solution, in conventional amounts. Many useful sequestering agents are known in the art, but particularly useful classes of compounds include, but are not limited to, multimeric carboxylic acids as described in U.S. Pat. No. 5,389,502 (Fitterman et al), aminopolycarboxylic acids, polyphosphate ligands, ketocarboxylic acids, and alkanolamines. Representative sequestering agents include ethylenediamine-tetraacetic acid, diethylenetriaminepentaacetic acid, 1,3-propylenediamine-tetraacetic acid, 1,3-diamino-2-propanoltetraacetic acid, ethylenediaminodisuccinic acid and ethylenediaminomonosuccinic acid.

The black-and-white developing composition can also contain other additives including various development restrainers, development accelerators, swelling control agents and stabilizing agents, each in conventional amounts. Examples of such components are described in U.S. Pat. No. 5,236,816 (noted above), U.S. Pat. No. 5,474,879 (Fitterman et al), Japanese Kokai 7-56286 and EP-A-0 585 792.

In the second step of black-and-white processing, a fixing composition containing a photographic fixing agent is used to remove silver. While sulfite ions are present and sometimes acts as a fixing agent, the primary photographic fixing agents used in the fixing composition are not sulfites. Rather, the useful photographic fixing agents are chosen from thiosulfates (including sodium thiosulfate, ammonium thiosulfate, potassium thiosulfate and others readily known in the art), cysteine (and similar thiol containing compounds), mercapto-substituted compounds (such as those described by Haist, *Modern Photographic Processing*, John Wiley & Sons, N.Y., 1979), thiocyanates (such as sodium thiocyanate, potassium thiocyanate, ammonium thiocyanate and others readily known in the art), amines and halides. Mixtures of one or more of these classes of fixing agents can be used if desired. Thiosulfates and thiocyanates are preferred.

The fixing composition can also include various addenda commonly employed therein, such as buffers, fixing accelerators, sequestering agents, swelling control agents, and stabilizing agents, each in conventional amounts. In its aqueous form, the fixing composition generally has a pH of at least 4, preferably at least 4.5, and generally less than 6, and preferably less than 5.5.

Other details for carrying out black-and-white processing using the delivery articles useful in this invention would be readily apparent from the teaching provided herein as well as the skill of one experienced in the photographic processing art.

The following TABLE I shows suggested general and preferred (in parentheses) concentrations for essential components of black-and-white processing compositions that would be used to make photochemical delivery articles. The ranges given in TABLE I have end points that are approximate ("about"). Other components of the processing compositions would be readily apparent to one skilled in the art. TABLE I also shows approximate times and temperatures for contacting the photochemical delivery articles with imaged black-and-white materials.

TABLE I

| Processing Step | Essential Photochemical | Concentration (mol/l) | Contact Time (sec) | Contact Temperature (° C.) |
|---|---|---|---|---|
| Development | Developing agent(s): hydroquinones or ascorbic acid derivatives | 0.02–0.5 (0.03–0.4) | 20–480 (30–180) | 25–60 (35–45) |
| | Co-developing agent(s): substituted pyrazolidinones | 0–0.05 (0.005–0.015) | Same | Same |
| | Antioxidant(s): various sulfites | 0.1–0.5 (0.3–0.4) | Same | Same |
| Fixing | Fixing agent(s): thiosulfates | 0.3–2 (1–1.5) | 15–600 (20–60) | 20–60 |

TABLE I-continued

Color Image Formation

Color image formation in various color photographic materials require certain essential photochemicals including a color developing agent, a photographic bleaching agent and a fixing agent (or both photographic bleaching and fixing agents). Other useful photochemicals may be needed for various processing methods including, but are not limited to, black-and-white developing agents, co-developing agents, dye stabilizing agents, fixing accelerators, bleaching accelerators, antifoggants, fogging agents and development accelerators. In other instances, the photochemicals may provide a physical benefit such as reduced scumming, reduced crystal growth on processing equipment, reduced sludge, reduced film residue or spotting, storage stability and reduced biogrowth. Examples of such photochemicals include, but are not limited to, surfactants, antioxidants, crystal growth inhibitors and biocides.

Thus, delivery articles can be designed and used for color development, bleaching, fixing (or bleach-fixing), and optionally a dye stabilizing step. This is generally understood from the conventional Process C-41 processing method for color negative films. Obtaining color positive images in color reversal materials require another unique set of processing steps that are well known in the art (for example, using the conventional Process E-6 or K-25 processing). In addition, obtaining color images in color papers can be achieved using the conventional Process RA steps of color development and bleach-fixing. Motion picture films and prints may include still other processing steps. However, all of these steps and the conventional components of the processing compositions are well known, as described for example, in *Research Disclosure* publication 308119, December 1989, publication 17643, December 1978, and publication 38957, September, 1996. Some additional details are provided below in describing such compositions, but additional details can be supplied from the many publications listed in the noted *Research Disclosure* publications.

Color developing compositions include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957 (noted above).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect color developing agents from oxidation, one or more antioxidants are generally included. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending U.S. Ser. No. 09/123,976 (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804 (Vincent et al), U.S. Pat. No. 4,876,174 (Ishikawa et al), U.S. Pat. No. 5,354,646 (Kobayashi et al) and U.S. Pat. No. 5,660,974 (Marrese et al), and U.S. Pat. No. 5,646,327 (Burns et al), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. One useful hydroxylamine antioxidant is N,N-diethylhydroxylamine.

In other embodiments, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine.

It may be desirable to include a chemical base in the color developing composition. Particularly useful chemical bases include inorganic bases such as alkali metal or ammonium hydroxides (for example sodium hydroxide or potassium hydroxide). Other useful chemical bases are alcoholamines (such as triethanolamine, and diethanolamine).

Another component of the color developing composition can be one or more triazinylstilbene optical brightening agents. In some publications, triazinylstilbenes are identified as "triazylstilbenes". Preferably, the useful triazinylstilbenes are water-soluble or water-dispersible. Representative compounds are shown in U.S. Pat. No. 4,232,112 (Kuse), U.S. Pat. No. 4,587,195 (Ishikawa et al), U.S. Pat. No. 4,900,651 (Ishikawa et al) and U.S. Pat. No. 5,043,253 (Ishakawa), all incorporated herein by reference with respect to such compounds. The most preferred triazinylstilbene compounds (and isomers thereof) include compounds commercially available as BLANKOPHOR REU (Bayer) and TINOPAL SFP (Ciba).

One or more buffering agents are generally present in the color developing compositions to provide or maintain desired alkaline pH. These buffering agents generally have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

Polycarboxylic acid or phosphonic acid metal ion sequestering agents are useful in the color developing composition. Such materials are well known in the art, and are described for example in U.S. Pat. No. 4,596,765 (Kurematsu et al) and *Research Disclosure* publications 13410 (June, 1975), 18837 (December, 1979) and 20405 (April, 1981). Useful sequestering agents are readily available from a number of commercial sources. Particularly useful phosphonic acids are the diphosphonic acids (and salts thereof) and polyaminopolyphosphonic acids (and salts thereof). Useful diphosphonic acids include hydroxyalkylidene diphosphonic acids, aminodiphosphonic acids, amino-N,N-dimethylenephosphonic acids, and N-acyl aminodiphosphonic acids.

One useful class of diphosphonic acids includes hydroxyalkylidene diphosphonic acids (or salts thereof). Mixtures of such compounds can be used if desired. Useful salts include the ammonium and alkali metal ion salts. Representative sequestering agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is available as DEQUES™ 2010. Its tetrasodium salt is available as DEQUEST™ 2016D. Both materials are available from Solutia Co. Another useful disphosphonic acid is morpholinomethanediphosphonic acid or a salt thereof. A mixture of one or more diphosphonic acids can be used in the color developing composition of this invention if desired, in any desirable proportions.

Another useful sequestering agent is a polyaminopolyphosphonic acid (or salt thereof) that has at least five phosphonic acid (or salt) groups. A mixture of such compounds can be used if desired. Suitable salts include ammonium and alkali metal (for example, sodium and potassium) ion salts. A particularly useful sequestering agent of this type is diethylene-triaminepentamethylenephosphosphonic acid or an alkali metal salt thereof (available as DEQUEST™ 2066 from Solutia Co.).

It is also possible to include other metal ion sequestering agents (for example, for iron, copper or manganese ion sequestration) in the color developing composition. The composition can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, wetting agents, fragrances, stain reducing agents, surfactants, defoaming agents, and water-soluble or water-dispersible color dye forming couplers, as would be readily understood by one skilled in the art [see for example, the *Research Disclosure* publications noted above]. The amounts of such additives would be well known to a skilled artisan.

Rapid color development is contemplated in one embodiment of the invention. The more active color developing agents and higher temperatures employed in rapid development can be used at conventional or extended times in order to facilitate image dye formation, as well as reduced times in order to provide faster access to the image. Color developing compositions and processing conditions useful in the practice of the invention are disclosed for example in U.S. Pat. No. 5,118,591 (Koboshi et al), U.S. Pat. No. 5,573,424 (Ishikawa et al) and U.S. Pat. No. 5,922,519 (Ishikawa et al).

In one embodiment of this invention, a photochemical delivery article consists essentially of a nonporous, dimensionally stable substrate having disposed thereon a poly (ethyleneoxide) hydrogel containing one or more diffusible color development photochemicals.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly usefull chelating ligands include conventional polyaminopolycarboxylic acids including ethylenediaminetetraacetic acid (EDTA), propylenediaminetetraacetic acid (PDTA) and others described in *Research Disclosre* publication 38957 (noted above), U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al).

These and many other such complexing ligands known in the art including those described in U.S. Pat. No. 4,839,262 (Schwartz), U.S. Pat. No. 4,921,779 (Cullinan et al), U.S. Pat. No. 5,037,725 (noted above), U.S. Pat. No. 5,061,608 (Foster et al), U.S. Pat. No. 5,334,491 (Foster et al), U.S. Pat. No. 5,523,195 (Darmon et al), U.S. Pat. No. 5,582,958 (Buchanan et al), U.S. Pat. No. 5,552,264 (noted above), U.S. Pat. No. 5,652,087 (Craver et al), U.S. Pat. No. 5,928,844 (Feeney et al) U.S. Pat. No. 5,652,085 (Wilson et al), U.S. Pat. No. 5,693,456 Foster et al), U.S. Pat. No. 5,834,170 (Craver et al), and U.S. Pat. No. 5,585,226 (Strickland et al), all incorporated herein by reference for their teaching of bleaching compositions.

Other components of the bleaching solution include buffers, halides, corrosion inhibiting agents, and metal ion sequestering agents. These and other components and conventional amounts are described in the references in the preceding paragraph. The pH of the bleaching composition is generally from about 4 to about 6.5.

Particularly useful bleaching agents are ferric ion complexes of one or more of ethylenediaminetetraacetic acid (EDTA), ethylenediaminedisuccinic acid (EDDS, particularly the S,S-isomer), methyliminodiacetic acid (MIDA) or other iminodiacetic acids, β-alaninediacetic acid (ADA), ethylenediamine-monosuccinic acid (EDMS), 1,3-propylenediaminetetraacetic acid (PDTA), nitrilotriacetic acid (NTA), and 2,6-pyridinedicarboxylic acid (PDCA). Multiple bleaching agents can be present if desired.

Useful fixing agents for photographic fixing compositions are well known. Examples of photographic fixing agents include, but are not limited to, thiosulfates (for example sodium thiosulfate, potassium thiosulfate and ammonium thiosulfate), thiocyanates (for example sodium thiocyanate, potassium thiocyanate and ammonium thiocyanate), thioethers (such as ethylenebisthioglycolic acid and 3,6-dithia-1, 8-octanediol), imides and thiourea. Thiosulfates and thiocyanates are preferred, and thiosulfates are more preferred. Ammonium thiosulfate is most preferred.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing accelerators are described in U.S. Pat. No. 5,633,124 (Schmittou et al), incorporated herein for the teaching of fixing compositions. The use of thiocyanate as a fixer accelerator for promoting rapid clearing is disclosed in U.S. Pat. No. 6,022,676 (Schmittou et al) that is also incorporated herein by reference.

The fixing compositions can contain one or more monovalent or divalent cations supplied by various salts used for various purposes (for example, salts of fixing agents). It is preferred that the cations be predominantly ammonium cations, that is at least 50% of the total cations are ammonium ions.

The fixing compositions can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art.

The desired pH of the fixing compositions is 8 or less, and can be achieved and maintained using any useful combination of acids and bases, as well as various buffers.

Other details of fixing compositions not explicitly described herein are considered well known in the art, and are described for example, in *Research Disclosure* publication 38957 (noted below), and publications noted therein in paragraph XX(B), U.S. Pat. No. 5,424,176 (Schmittou et al), U.S. Pat. No. 4,839,262 (noted above), U.S. Pat. No. 4,921,779 (noted above), U.S. Pat. No. 5,037,725 (noted above), U.S. Pat. No. 5,523,195 (noted above), U.S. Pat. No. 5,552,264 (noted above), all incorporated herein by reference for their teaching of fixing compositions.

Another photographic processing composition that may be useful is a dye stabilizing composition containing one or more photographic imaging dye stabilizing compounds. Such compositions can be used at the end of the processing sequence (such as for color negative films and color papers), or in another part of the processing sequence (such as between color development and bleaching as a pre-bleaching composition).

Such dye stabilizing compositions generally have a pH of from about 5.5 to about 8, and include a dye stabilization compound (such as an alkali metal formaldehyde bisulfite, hexamethylenetetramine, various benzaldehyde compounds, and various other formaldehyde releasing compounds), buffering agents, bleach-accelerating compounds, secondary amines, preservatives, and metal sequestering agents. All of these compounds and useful amounts are well known in the art, including U.S. Pat. No. 4,839,262 (Schwartz), U.S. Pat. No. 4,921,779 (noted above), U.S. Pat. No. 5,037,725 (noted above), U.S. Pat. No. 5,523,195 (noted above) and U.S. Pat. No. 5,552,264 (noted above), all incorporated herein by reference for their teaching of dye stabilizing compositions.

A preferred dye-stabilizing composition includes sodium formaldehyde bisulfite as a dye stabilizing compound, and thioglycerol as a bleach-accelerating compound. This composition can also be used as a pre-bleaching composition during the processing of color reversal photographic materials.

In some processing methods, a dye stabilizing composition or final rinsing composition is used to clean the processed photographic material as well as to stabilize the color image. Either type of composition generally includes one or more anionic, nonionic, cationic or amphoteric surfactants, and in the case of dye stabilizing compositions, one or more dye stabilizing compounds as described above. Particularly useful dye stabilizing compounds useful in these dye stabilizing compositions are described for example in EP-A-0 530 832 (Koma et al) and U.S. Pat. No. 5,968,716 (McGuckin et al). Other components and their amounts for both dye stabilizing and final rinsing compositions are described in U.S. Pat. No. 5,952,158 (McGuckin et al), U.S. Pat. No. 3,545,970 (Giorgianni et al), U.S. Pat. No. 3,676,136 (Mowrey), U.S. Pat. No. 4,786,583 (Schwartz), U.S. Pat. No. 5,529,890 (McGuckin et al), U.S. Pat. No. 5,578,432 (McGuckin et al), U.S. Pat. No. 5,534,396 (noted above), U.S. Pat. No. 5,645,980 (McGuckin et al), U.S. Pat. No. 5,667,948 (McGuckin et al), U.S. Pat. No. 5,750,322 (McGuckin et al) and U.S. Pat. No. 5,716,765 (McGuckin et al), all of which are incorporated by reference for their teaching of such compositions.

TABLE II below shows suggested general and preferred (in parentheses) concentrations for essential components of color processing compositions that would be used to make photochemical delivery articles useful this invention. The ranges given in TABLE II have end points that are approximate ("about"). Other components of the processing compositions would be readily apparent to one skilled in the art. TABLE II also shows approximate times and temperatures for contacting the photochemical delivery articles with imaged color materials.

TABLE II

| Processing Step | Essential Photochemical | Concentration (mol/l) | Contact Time (sec) | Contact Temperature (° C.) |
|---|---|---|---|---|
| Color Development | Color developing agent(s) | 0.005–0.065 (0.015–0.06) | 30–300 (50–180) | 30–60 (35–50) |
| | Antioxidant(s): sulfites or hydroxylamine and derivatives | 0.01–0.1 (0.01–0.05) | Same | Same |
| Bleaching or Bleach-fixing | Bleaching agent: ferric poly-carboxylates | 0.005–1 (0.1–0.5) | 10–240 (20–180) | 25–60 |
| Fixing or Bleach-Fixing | Fixing agent(s): thiosulfate(s) | 0.5–2 (0.8–1.5) | 20–300 (30–180) | 25–60 |
| Dye Stabilizing | Dye Stabilizing compound: aldehyde(s) | 0–0.05 (0–0.02) | 0–180 (0–30) | 25–60 |
| B & W Developing (for color reversal) | B & W Developing agent: hydroquinones | 0.1–0.5 (0 15–0.4) | 180–500 (300–400) | 30–60 (35–55) |
| | Co-developing agent: substituted pyrazolidinone | 0.001–0.5 (0.005–0.15) | Same | Same |

As noted above, the compositions described above can be present in photochemical delivery articles and used to process black-and-white or color photographic silver halide materials, including but not limited to, black-and-white films and papers, color negative photographic films, color reversal photographic films, and color photographic papers. The general sequence of steps and conditions (times and temperatures) for color photographic processing are well known as Process C-41 (for example, using KODAK FLEXICOLOR photochemicals) and Process ECN-2 for color negative motion films, Process E-6 and Process K-14 for color reversal films, Process ECP for color prints, and Process RA-4 for color papers. Black-and-white photographic processing methods and conditions are also well known (Process RP X-OMAT for radiographic materials processing, Process VERSAMAT 641 or 885 for black-and-white aerial film processing, and Process PROSTAR PLUS for graphic arts film processing).

The photographic materials can be single or multilayer color elements. Multilayer color materials typically contain dye image-forming units sensitive to each of the three primary regions of the visible spectrum. Each unit can be comprised of a single emulsion layer or multiple emulsion layers sensitive to a given region of the spectrum. The layers of the material can be arranged in any of the various orders known in the art. In an alternative format, the emulsions sensitive to each of the three primary regions of the spectrum can be disposed as a single segmented layer. The materials can also contain other conventional layers such as filter layers, interlayers, subbing layers, overcoats and other layers readily apparent to one skilled in the art. A magnetic backing can be included on the backside of conventional supports.

More details of the photographic material structure and components, and suitable methods of processing various types of color elements are described in *Research Disclosure* publication 38957 (noted above). Included within such teachings in the art is the use of various classes of cyan, yellow and magenta color couplers that can be used with the present invention (including pyrazolone and pyrazolotriazole type magenta dye forming couplers).

Thus, a wide variety of types of photographic materials (both black-and-white and color negative and color reversal films and papers, and color motion picture films and prints) containing various types of emulsions can be processed using the present invention, the types of materials being well known in the art (see *Research Disclosure* publication 38957 noted above). The invention can be used to process color photographic papers of all types of emulsions including so-called "high chloride" and "low chloride" type emulsions, and so-called tabular grain emulsions as well.

Representative commercial black-and-white films and papers that are useful in the practice of this invention include, but are not limited to, KODAK T-MAX 400 Film, KODAK TRI-X Pan Film, KODAK VERICHROME PAN Film, KODAK POLYMAX II RC Black and White Papers, KODAK KODABROME II RC F Black and White Paper, KODAK PMAX Art RC V Black and White Paper, KODAK POLYCONTRAST III RC Black and White Paper, KODAK PANALURE Select RC Black and White Paper, KODAK POLYMAX FINE ART Black and White Papers, KODAK AZO Black and White Papers, ILFORD MULTIGRADE IV RC and FB Black and White Papers, ILFORD ILFOBROME GALARIE Black and White Papers, and AGFA MULTICONTRAST CLASSIC and PREMIUM Black and White Papers.

Representative commercial color papers that are useful in the practice of this invention include, but are not limited to, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic materials would be readily determined by one skilled in the art.

KODAK DURATRANS, KODAK DURACLEAR, KODAK EKTAMAX and KODAK DURAFLEX photographic materials and KODAK Digital Paper Type 2976 can also be processed using the present invention.

Representative color negative films that can be processed using the delivery articles of this invention include, but are not limited to, KODAK ROYAL GOLD™ films, KODAK GOLD™ films, KODAK PRO GOLD™ films, KODAK FUNTIME™, KODAK EKTAPRESS PLUS™ films, EASTMAN EXR™ films, KODAK ADVANTiX™ films, FUJI SUPER G Plus films, FUJI SMARTFILM™ products, FUJICOLOR NEXIA™ films, KONICA VX films, KONICA SRG3200 film, 3M SCOTCH™ ATG films, and AGFA HDC and XRS films. Films suitable for processing according to this invention can also be those incorporated into what are known as "one time use cameras".

More preferred color negative films for processing with the method of the present invention are films intended for scanning and electronic image processing rather than optical printing, as described for example in U.S. Ser. No. 09/066,137 filed Apr. 14, 1998 by Sowinski et al and U.S. Pat. No. 6,021,277 (Sowinski et al), the disclosures of which are incorporated herein by reference. The present invention can be used to process a color photographic silver halide material comprised of a blocked but releasable photochemical (such as a blocked but releasable color developing agent). Such a material is disclosed for example in U.S. Ser. No. 09/475,510 filed Dec. 30, 1999 by Irving et al, the disclosure of which is incorporated herein by reference. The photochemical(s) provided by lamination of the photochemical delivery article to a photographic material containing such a releasable, photographically usefull chemical can be an chemical acid or a base that releases the blocked photochemical.

Other materials useful in the practice of this invention are color negative films that have specific dye forming coupler concentrations in each color recording unit (for example, at least 400 mg/m$^2$), or that include one or more "bleach accelerating releasing couplers" (BARC's) in such recording units at a coverage of at least 20 mg/m$^2$.

Alternatively, if the color negative films are to be scanned prior to fixing, it is desirable to omit color masking couplers or dyes, filter dyes and antihalation dyes in order to reduce scanning induced noise. Such films may also contain less silver than most color negative films, that is less than 3.5 g/m$^2$, and preferably from about 1.5 to about 3 g/m$^2$.

The present invention can also be used to provide positive color images in color reversal photographic films. The typical sequence of steps includes first development (black-and-white development), reversal processing step, color developing, bleaching, fixing, and stabilizing. There may be various washing steps between other steps, as well as a pre-bleach step or conditioning step before bleaching. Alternatively, dye stabilizing can occur between color developing and bleaching. Many details of such processes are provided in U.S. Pat. No. 5,552,264 (noted above), incorporated herein by reference. Other details are provided in *Research Disclosure*, publication 38957 (noted above), and references noted therein. Useful reversal compositions are described, for example, in U.S. Pat. No. 3,617,282 (Bard et al), U.S. Pat. No. 5,736,302 (Buongiorne et al) and U.S. Pat. No. 5,81 1,225 (McGuckin et al).

The first developing step is usually carried out using a conventional black-and-white developing solution that can contain black-and-white developing agents, auxiliary co-developing agents, preservatives, antifoggants, antisludging agents, buffers and other conventional addenda as described above. Useful first developing compositions are described for example, in U.S. Pat. No. 5,298,369 (Munshi et al), and U.S. Pat. No. 5,552,264 (noted above).

Color reversal films are comprised of a support having thereon a plurality of photosensitive silver halide emulsion layers that can contain any conventional silver halide (or mixture thereof). Such films generally have silver halide emulsions having at least 1 mol % iodide based on total silver. Some specific commercially available color reversal photographic films that can be processed using this invention include EKTACHROME Color Reversal Films (Eastman Kodak Company), FUJICHROME Color Reversal Films (Fuji Photo Film Co., Ltd.), AGFACHROME Color Reversal Films (AGFA) and KONICACHROME Color Reversal Films (Konica).

The method of this invention can therefore be practiced by separate application of individual photochemical delivery articles in a desired sequence. For example, for processing imaged color negative films, delivery articles can be applied to the film to provide, individually, at least color development, bleaching and fixing. For imaged color papers, delivery articles can be applied to accomplish, in order, color development and bleach-fixing. Still again, for processing color reversal films, delivery articles can be applied in order to accomplish at least black-and-white development, a reversal step (universal fogging), color development, bleaching and fixing. Imaged black-and-white materials would require contact with delivery articles for development and fixing.

The photochemical delivery articles useful in this invention can be provided in any suitable shape or size. They can be used right after photochemical compositions are imbibed therein, or they can be wound into roll form and stored into a magazine or cartridge in sealed and protected condition to preserve moisture context and photochemical integrity and activity. For example, developing agents can be protected from aerial oxidation in this manner.

In another embodiment, the photochemical delivery articles can be dehydrated for storage and re-swollen with water or an "activator" solution (such as a basic aqueous solution) at the time of use.

One method of practicing this invention can be achieved by contacting an imagewise exposed photographic material (for example a roll of imaged color negative film, or strips of a certain number of "frames") with the appropriate photochemical delivery articles in their swollen state to form a laminate. The delivery article is generally brought into reactive association with the silver halide emulsion layer side of the photographic material, not the support side so photochemicals can readily enter the emulsion layer(s) and cause the desired photochemical reactions. Applying liquids such as water, an activator solution, a photochemical processing solution (or its concentrate), or a surfactant or spreading agent solution, or applying pressure may improve the contact and the rate of photochemical delivery and chemical reaction. Such liquids can be added to the delivery article prior to or during contact with the photographic silver halide material. Agitation is not required in the practice of the invention, but sustained pressure, variable kneading, or rolling motions applied to the laminated photographic material and hydrogel can aid the transfer of reagent from the photochemical delivery article. In one embodiment of the invention, the backing substrate that supports the hydrogel is not permanently bonded to the hydrogel and is removed, providing access to the laminate from the backside of the photochemical delivery article. Thus, water, activator solution, a photoprocessing solution or other aqueous solution can be added to the laminate at any time during the contact to increase swelling and reaction time. Subsequent capillary action or osmotic pressure at the interface will drive the swelling of the imaged photographic material with the photochemical processing solution in the hydrogel. Concentration gradients of soluble photochemicals will drive exchange between the hydrogel matrix and the contacted photographic material until equilibrium is achieved. Obviously, contact of the delivery article must be to the silver halide emulsion side of the imagewise exposed photographic material. Thus, the silver halide emulsion(s) are in direct contact with the delivery article or in reactive association meaning that the photochemicals can diffuse from the delivery article into the photographic material.

The rate of photochemical delivery and processing can be accelerated by pre-swelling the photographic recording material with water or an aqueous solution such as a photochemical processing solution or concentrate, or activator solution. The subsequent application of the delivery article by lamination can reduce or eliminate the requirement of a high-precision spreading apparatus for metering a pre-delivered solution for swelling the photographic silver halide material. Alternatively, the delivery article can perform as the spreading apparatus when supplemental processing solution is added from the support-side of the hydrogel after removal of the supporting substrate.

In some instances, it may be desirable to heat the imagewise exposed photographic material prior to and/or during contact with the photochemical delivery article in order to quicken photochemical reactions or release reactants within the photographic material. This may be especially desirable for processing color photothermographic materials. For the purposes of this invention, photothermographic materials (providing either color or black-and-white images) are considered to be within the definition of "photographic materials" and the photothermographic emulsion layer is considered a "silver halide emulsion layer".

Specific contacting and reaction conditions for various black-and-white and color photoprocessing conditions are provided in TABLES I and II above. However, generally, the contact of photochemical delivery article and imagewise exposed photographic material is for at least 15 seconds, and preferably for from about 30 to about 120 seconds. Processing temperature is at least 25° C., and preferably from about 40 to about 60° C.

In a preferred processing embodiment, water, activator solution or photoprocessing solution is supplied to the laminate of photochemical delivery article and imaged photographic material to increase the rate of swelling and photochemical reaction (for example color development). This is preferably done somewhat higher than room temperature, for example at from about 40 to about 50° C. After adequate photochemical reaction(s) have occurred, the hydrogel can be pulled away from the processed photographic material and disposed of in a suitable fashion (for example wound into a magazine) or recycled for future reuse (used again to imbibe photochemicals). When a removable supporting substrate is stripped from the photographic material-hydrogel laminate prior to the completion of the photographic processing (for example in order to add supplemental processing solution), the hydrogel may then be delaminated subsequently with a scraper, blade, or other suitable abrader to mechanically separate them. If the hydrogel was impregnated onto a suitable support mesh or scrim, the hydrogel can still be pulled away from the processed photographic material for storage or disposal as before.

The photographic silver halide materials can be scanned immediately after processing with one or more delivery articles or after partial or complete fixing. Preferably, both development and fixing are carried out before scanning.

Once distinguishable images or one or more color records have been formed in the processed photographic materials, conventional techniques can be employed for retrieving the image information for each color record and manipulating the record for subsequent creation of a color balanced viewable image. For example, it is possible to scan a color photographic material successively within the blue, green, and red regions of the spectrum or to incorporate blue, green, and red light within a single scanning beam that is divided and passed through blue, green, and red filters to form separate scanning beams for each color record. If other colors are imagewise present in the material, then appropriately colored light beams are employed. A simple technique is to scan the photographic material point-by-point along a series of laterally offset parallel scan paths. A sensor that converts radiation received into an electrical signal notes the intensity of light passing through the material at a scanning point. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

An image scanner is used to scan an imagewise exposed and photographically processed color negative material delivered from a developing station. As the element is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information can be fed to Digital Image Processor, and the information transformed into an electronic form which can be stored in any convenient storage device or otherwise delivered to the customer by any convenient method.

In one embodiment, it is specifically contemplated to scan a developed image to red, green and blue light to retrieve imagewise recorded information and to scan the same image to infrared light for the purpose of recording the location of non-image imperfections. When such an imperfection or "noise" scan is employed, the signals corresponding to the imperfection can be employed to provide a software correction so as to render the imperfections less noticeable or totally non-noticeable in soft or hard copy form. The hardware, software and technique for achieving this type of imperfection reduction is described by U.S. Pat. No. 5,266,805 (Edgar) and WO 98/31142 (Edgar et al), WO 98/34397 (Edgar et al), WO 99/40729 (Edgar et al) and WO 99/42954 (Edgar et al).

In another embodiment, the developed image can be scanned multiple times by a combination of transmission and reflection scans, optionally in the infrared and the resultant files combined to produce a single file representative of the initial image. Such a procedure is described by U.S. Pat. No. 5,465,155 (Edgar), U.S. Pat. No. 5,519,510 (Edgar), U.S. Pat. No. 5,790,277 (Edgar),U.S. Pat. No. 5,988,896 (Edgar), EP-A-0 944,998, WO 99/43148, WO 99/43149 and WO 99/42954.

Elements having calibration patches derived from one or more patch areas exposed onto a portion of unexposed photographic material as described in U.S. Pat. No. 5,649,260 (Wheeler et al), U.S. Pat. No. 5,563,717 (Koeng et al) and U.S. Pat. No. 5,644,647 (Cosgrove et al) can be usefully employed.

In addition, categorization of the element by an identifying encodement is useful for ensuring that the correct processing parameters are used, as described in copending U.S. Ser. No. 09/456,613, filed Dec. 8, 1999 by Szajewski et al.

Additional illustrative systems for manipulation of digital signals include techniques for maximizing the quality of image records, are disclosed by U.S. Pat. No. 4,553,156 (Bayer), U.S. Pat. No. 4,591,923 (Urabe et al), U.S. Pat. No. 4,631,578 (Sisaki et al), 4,654,722 (Alkofer), U.S. Pat. No. 4,670,793 (Yamada et al), U.S. Pat. No. 4,694,342 (Klees) and U.S. Pat. No. 4,962,542 (Klees), U.S. Pat. No. 4,805,031 (Powell), U.S. Pat. No. 4,829,370 (Mayne et al), U.S. Pat. No. 4,839,721 (Abdulwahab), U.S. Pat. No. 4,841,361 (Matsunawa et al), U.S. Pat. No. 4,937,662 (Matsunawa et al), U.S. Pat. No. 4,891,713 (Mizukoshi et al), U.S. Pat. No. 4,912,569 (Petilli), U.S. Pat. No. 4,920,501 (Sullivan et al), U.S. Pat. No. 5,070,413 (Sullivan et al), U.S. Pat. No. 4,929,979 (Kimoto et al), U.S. Pat. No. 4,972,256 (Hirosawa et al), U.S. Pat. No. 4,977,521 (Kaplan et al), U.S. Pat. No. 4,979,027 (Sakai et al), U.S. Pat. No. 5,003,494 (Ng), U.S. Pat. No. 5,008,950 (Katayama et al), U.S. Pat. No. 5,065,255 (Kimura et al), U.S. Pat. No. 5,051,842 (Osamu et al), U.S. Pat. No. 5,012,333 (Lee et al), U.S. Pat. No. 5,107,346 (Bowers et al), U.S. Pat. No. 5,105,266 (Telle), U.S. Pat. No. 5,105,469 (MacDonald et al), and U.S. Pat. No. 5,081,692 (Kwon et al). Techniques for color balance adjustments during scanning are disclosed in U.S. Pat. No. 5,049,984 (Moore et al) and U.S. Pat. No. 5,541,645 (Davis).

Once acquired, the digital color records can be in most instances adjusted to produce a pleasingly color balanced image for viewing and to preserve the color fidelity of the image bearing signals through various transformations or renderings for outputting, either on a monitor or when provided as a color print. A suitable method for color balancing and image processing of electronic image-bearing signals in digital form (density representative electronic signals) is taught in copending U.S. Ser. No. 09/104,548 filed June 25, by Buhr et al, the disclosure of which is incorporated herein by reference (corresponding to EP-A-0 961 482).

Further techniques for transforming image-bearing signals after scanning are disclosed in U.S. Pat. No. 5,267,030 (Giorgianni et al), U.S. Pat. No. 5,528,339 (Buhr et al), U.S. Pat. No. 5,835,627 (Higgins et al), U.S. Pat. No. 5,694,484 (Cottrell et al) and U.S. Pat. No. 5,962,205 (Arakawa et al), the disclosures of all of which are incorporated by reference. Further illustrations of these procedures are provided by Giorgianni and Madden Digital Color Management, Addison-Wesley, 1998. The signal transformation techniques disclosed can be further modified so as to deliver an image that incorporates the look selected by a customer.

Matrices and look-up tables (LUTs) can provide useful image transformation. In one embodiment, three 1-dimensional look-up tables can be employed, one for each of a red, green, and blue color record. Due to the complexity of these transformations, it should be noted that the transformation can often be better accomplished by a 3-dimensional LUT. In another embodiment, a multi-dimensional look-up table can be employed, all as described in U.S. Pat. No. 4,941,039 (D'Errico).

In one variation, the R, G, and B image-bearing signals from a transmission scanner are converted to an image metric which corresponds to that from a single Teference image-recording device or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film, the R, G, and B image-bearing signals from a scanner would be transformed to the R', G', and B' density values corresponding to those of an image which would have been formed by the reference color negative film had it been exposed under the same conditions under which the actual color negative material was exposed.

In another variation, if the reference image recording medium was chosen to be a specific color negative film, and the intermediary image data metric was chosen to be the predetermined R', G', and B' intermediary densities of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the actual color negative recording material was exposed.

Thus each input film calibrated to be compatible with the present method would yield, insofar as possible, identical intermediary data values corresponding to the R', G', and B' code values required to appropriately reproduce the color image which would have been formed by the reference color negative film on a reference output device. Uncalibrated photographic films may also be used with transformations derived for similar types of films, and the results would be similar to those described.

It is to be appreciated that while the images are in electronic or digital form, the image processing is not limited to the specific manipulations described above. Other usefull image manipulation sequences are described by EP-A-0 961,482 (Buhr et al), EP-A-0 961,483 (Buhr et al), EP-A-0 961,484 (Buhr et al), EP-A-0 961,485 (Buhr et al) and EP-A-0 961,486 (Buhr et al), the disclosures of all of which are incorporated by reference. While the images are in digital form, additional image manipulation may be used including, but not limited to, scene balance algorithms (to determine corrections for density and color balance based on the densities of one or more areas within the processed film), tone scale manipulations to amplify film underexposure gamma as described in U.S. Pat. No. 5,134,573 (Goodwin et al), non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations as known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, ink-jet printers, display monitors, CD disks, optical and magnetic electronic signal storage devices, and other types of storage and display devices as known in the art.

It will be appreciated that the output image-bearing signals can be for a reference output device, can be in the form of device-specific code values or can require firther adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

The manipulated digital signals (that is, the digital records) can also be forwarded to a suitable output device to provide a display image or stored for future use. The output device may take a number of forms such as a CRT display, CD disk, magnetic devices or other type of storage or output device readily apparent to one skilled in the art.

Besides digital manipulation, the digital images can be used to change physical characteristics of the image, such as "windowing" and "leveling" (used in computed tomography scanning) or other manipulations known in the art.

The following examples are provided for illustrative purposes, and are not to be meant as limiting in any way.

Example 1

Color Development of Positive Display Image

A sample of BARD Vigilon™ wound dressing was imbibed with a commercially available color developing composition (KODAK FLEXICOLOR Color Developer) to provide a photochemical delivery article. A sample of KODAK DURACLEAR RA Display Material (code 4004) was imagewise exposed using conventional procedures and laminated to the delivery article. The resulting laminate was heated to about 49° C. After 55 seconds of contact, the processed photographic material was pulled away from the delivery article having a viewable positive color image.

The imaged film was further manipulated by electronically scanning using a commercially available Microtek III flatbed scanner, and the scanned image was digitized, zoomed and cropped to adjust image composition. The digital file containing the image was digitally manipulated to adjust color and tone scale while being viewed on a display device. The corrected image was stored and subsequently digitally transmitted to a remote site for viewing.

The scanning step was repeated using a commercially available Nikon Coolscan-2000 film scanner (using Digital ICE Technology), and the scanned image was digitized, zoomed and cropped to adjust image composition. The digital file containing the image was digitally manipulated to adjust color and tone scale while being viewed on a display. The corrected image was enlarged and printed using a commercially available ink-jet printer, and also stored and digitally transmitted to a remote site for viewing.

Example 2

Color Development of Color Negative Image

A photochemical delivery article was prepared as described in Example 1. A sample of KODAK GOLD Ultra 400 Color Negative Film was imagewise exposed and processed using the delivery article as described in Example 1. After delamination, the processed film contained the desired color negative image. This image was electronically scanned using a commercially available scanning device, and the scanned image was digitized, zoomed and cropped to adjust image composition. The digital file containing the image was digitally manipulated to adjust color and tone scale while being viewed on a suitable display device. The corrected color image was stored and subsequently digitally transmitted to a remote site for viewing.

Example 3

Color Development of Color Negative Images

Samples of KODACOLOR VR 200 Color Negative Film (or FUNTIME™ Color Negative Film) that contains tabular grain silver halide emulsions were imagewise exposed and processed as described in Example 1. Excellent density was observed in the resulting color images.

Examples 4 and 5

Bleaching and Fixing of Color Negative Film

Samples of commercially available KODAK GOLD 200 color negative film were imagewise exposed in a camera to a test chart at 200 ISO using controlled flash illumination. The film samples were then developed using commercially available KODAK FLEXICOLOR Color Developer for 3.25 minutes at 37.8° C. in a sinkline tank. Color development was stopped using a 5% glacial acetic acid Stop bath and washed in running water.

A BARD Vigilon™ primary wound dressing pad (hydrogel pad) was cut into 35 mm strips. The hydrogel pad is supplied with a thin polyethylene sheet on each side of the hydrogel. This sheet was removed from one side of the pad to expose the hydrogel matrix. These resulting strips were then soaked in a tray containing the KODAK FLEXICOLOR Bleach and Replenisher for at least 30 minutes. Another tray contained similar hydrogel strips imbibed with KODAK FLEXICOLOR Fixer and Replenisher.

The color developed film samples were cut into strips. One strip was bleached and fixed using standard Process C41 processing solutions and process times and temperatures, then washed and dried. This strip served as a Control.

A wet color developed film sample was placed, silver halide emulsion side up, in contact with a heated platen at 60° C. The water ensures that the strips stick to the platen and that there is good thermal contact.

For Example 4, an imbibed hydrogel strip (delivery article of this invention) was removed from the bleaching solution and excess solution was removed from its surface so that it appeared to be dry. This delivery article was then contacted with the emulsion side of a color developed film sample and gently rolled to remove air bubbles from the resulting laminate. This rolling action was continued during the bleaching time. After a defmed time the film sample and hydrogel laminate was removed from the platen and the two pieces peeled apart.

The film sample was then fixed using the conventional fixing solution in a sinkline and washed. This example enabled us to look at bleaching time at 60° C.

In Example 5, a film sample was bleached in the conventional bleaching solution in a sinkline. An imbibed hydrogel strip was removed from the fixer and the excess solution was removed from its surface so that it appeared dry. This delivery article was then contacted with the silver halide emulsion of the heated film sample, and gently rolled to remove air bubbles from the laminate. This rolling action was continued during the fixing time. The example enabled us to look at fixing time at 60° C.

After a defined time the film sample and delivery article laminate was removed from the platen and the two pieces were peeled apart. The film sample was then washed.

The results of these experiments are shown as follows. Acceptable bleaching required at least 35 seconds.

| Film Sample | Bleaching time(seconds) |
|---|---|
| 15 | 60 |
| 16 | 35 |
| 17 | 25 |
| 18 | 15 |
| 19 | 45 |

The resulting color negative images were scanned using a commercially available KODAK PHOTO IMAGING workstation at 16Base resolution. Commercially available ADOBE PHOTOSHOP software was then used to resize the digital color images. No image degradation was observed from the practice of this invention using the photochemical delivery article to bleach the photographic material in shortened bleaching times and at high temperature.

Example 6

Processing of Black-and-White Film

Samples of commercially available KODAK TMAX 400 black-and-white negative film were exposed in a camera to a test chart at 400 ISO using controlled flash illumination. The film samples were then developed using commercially available KODAK TMAX Developer 1+4 for 6.5 minutes at 21° C. in a Patterson (Nycore) tank. Development was stopped using commercially available KODAK Stop bath and the samples were washed water.

A BARD Vigilon™ primary wound dressing pad (hydrogel pad) was cut into 35 mm strips. The hydrogel pad is supplied with a thin polyethylene sheet on each side of the hydrogel, and the sheet was removed from one side to expose the hydrogel matrix. These strips were then soaked in a tray containing commercially available KODAK Fixer 3000 (1+3) for at least 30 minutes.

The developed film samples were cut into 2–3 frame strips. One sample was fixed in the tray containing the fixer solution for 5 minutes, then washed and dried to serve as the Control. Another wet film sample was placed, silver halide emulsion up, in contact with a heated platen.

An imbibed hydrogel strip (delivery article) was then removed from the fixer and the excess solution was removed from its surface so that it appeared dry. This delivery article was then placed in contact with the silver halide emulsion of the heated film sample, and gently rolled to remove air bubbles. This rolling action was continued during the fixing time.

After a defmed time the film sample and hydrogel laminate was removed from the platen and the two pieces were peeled apart. The film sample was then washed. It became apparent that the delivery article could be used more than once if more processing solution was imbibed.

The results are shown as follows:

| Film Sample | Heating Platen Temperature(° C.) | Fixing Time |
|---|---|---|
| 1 | 20 | 5 minutes(Check) |
| 2 | 60 | 1.5 minutes |
| 3 | 60 | 1 minute |
| 4 | 70 | 35 seconds |

In all cases the strips were fixed and were available for scanning. The resulting black-and-white negative images were scanned using a commercially available KODAK PHOTO IMAGING workstation at 16Base resolution. Commercially available ADOBE PHOTOSHOP software was then used to resize the digital color images. No image degradation was observed from the practice of this invention using the photochemical delivery article to fix the photographic material in shortened fixing times and at high temperature.

The invention has been described in detail with particular reference to preferred embodiments thereof, but it will be understood that variations and modifications can be effected within the spirit and scope of the invention.

We claim:

1. A method of providing an image in an imagewise exposed photographic silver halide material comprising at least one silver halide emulsion layer, the method comprising:

A) contacting a photochemical delivery article with a silver halide emulsion layer of said imagewise exposed photographic silver halide material to form a laminate to bring them into reactive association for a sufficient time to cause to a photochemical reaction and to provide a photographic image, said photochemical delivery article consisting essentially of a nonporous substrate having disposed thereon a hydrogel containing one or more diffusible photochemicals, and B) scanning the photographic image formed in step A to form density representative electronic signals.

2. The method of claim 1 wherein said substrate is less than 500 μm in thickness and is composed of a resin-coated paper, polyester, cellulosic polymer, polyethylene, polypropylene, polyethylene-polypropylene, polyvinyl chloride, polyvinylidene chloride, polyamide, polyurethane, polyvinyl alcohol, silicone rubber, polyvinyl (meth)acrylate or polystyrene.

3. The method of claim 2 wherein said substrate has a thickness of at least 75 μm, is dimensionally stable and is composed of a polyvinyl (meth)acrylate, polyethylene, polypropylene, resin-coated paper, or polyethylene-polypropylene.

4. The method of claim 1 wherein said hydrogel is formed from a polymethacrylic or polyacrylic ester, polyacrylamide or polymethacrylamide, N-vinyl-2-pyrrolidinone copolymer, a polymer containing oxyethylene or oxypropylene units, or a crosslinked methoxypoly(ethylene glycol).

5. The method of claim 4 wherein said hydrogel is composed of a polymer comprising oxyethylene or oxypropylene units, or both.

6. The method of claim 1 wherein said hydrogel is free of gelatin, gelatin derivatives or other hydrophilic colloidal materials.

7. The method of claim 1 further including a cover sheet.

8. The method of claim 1 comprising a black-and-white photochemical.

9. The method of claim 8 comprising a black-and-white developing agent.

10. The method of claim 1 comprising a color developing photochemical.

11. The method of claim 1 comprising a bleaching photochemical, fixing photochemical, or both.

12. The method of claim 1 wherein said photochemical delivery article is provided in roll form.

13. A method of providing a color image in an imagewise exposed color photographic silver halide material comprising at least one silver halide emulsion layer sensitive to visible radiation, the method comprising:

A) contacting a photochemical delivery article with a silver halide emulsion layer of said imagewise exposed color photographic silver halide material to form a laminate in reactive association for sufficient time to cause to a photochemical reaction and to provide a color photographic image, said photochemical delivery article consisting essentially of a nonporous polyethylene substrate having disposed thereon a poly (ethyleneoxide) hydrogel containing one or more diffusible photochemicals useful for providing a color image, and B) scanning the photographic image formed in step A to form density representative electronic signals.

14. The method of claim 12 wherein said photochemical delivery article comprises one or more photochemicals useful for color development.

15. The method of claim 12 wherein said method photochemical delivery article comprises one or more photochemicals useful for photographic bleaching, photographic fixing or both.

16. The method of claim 12 wherein said color photographic silver halide material is a color negative film.

17. The method of claim 12 wherein said color photographic silver halide material is a photographic color paper.

18. The method of claim 1 wherein step A is carried out for at least 15 seconds and at a temperature of from about 25 to about 60° C.

19. The method of claim 1 further comprising heating said imagewise exposed photosensitive material prior to or during step A.

20. The method of claim 1 wherein said photochemical delivery article contains a chemical base or acid as said photochemical and said photographic silver halide material comprises a blocked photographic processing chemical that is released by said chemical base or acid.

21. The method of claim 1 wherein water, an activator solution, a photochemical processing solution or a surfactant solution is applied to said photochemical delivery article prior to or during said contacting with said photographic silver halide material.

22. The method of claim 1 wherein pressure is applied to said laminate during step A.

23. The method of claim 1 wherein said photochemical delivery article comprises a removable substrate that is removed after the formation of said laminate and before step B.

24. The method of claim 23 wherein water, an activator solution, a photochemical processing solution or a surfactant solution is applied to said photochemical delivery article in said laminate after said removal of said removable substrate and before step B.

25. The method of claim 1 further comprising

C) digitally manipulating said density representative electronic signals obtained in step B to produce a digital record.

26. The method of claim 25 wherein said digital record is transmitted to an output device.

27. The method of claim 25 wherein a color negative image is obtained from a processed color negative film, and the density representative signals are used to correct tone or color in said color negative image.

28. The method of claim 25 wherein said digital record is stored, printed, transmitted or displayed.

29. A method of providing an image in an imagewise exposed photographic silver halide material comprising at least one silver halide emulsion layer, the method comprising:

A) contacting a photochemical delivery article with a silver halide emulsion layer of said imagewise exposed photographic silver halide material to form a laminate to bring them into reactive association for a sufficient time to cause to a photochemical reaction and to provide a photographic image, said photochemical delivery article consisting essentially of a nonporous substrate having disposed thereon a hydrogel containing a reinforcing material and one or more diffusible photochemicals, and B) scanning the photographic image formed in step A to form density representative electronic signals.

30. A method of providing an image in an imagewise exposed photographic silver halide material comprising at least one silver halide emulsion layer, the method comprising:

A) contacting a photochemical delivery article with a silver halide emulsion layer of said imagewise exposed photographic silver halide material to form a laminate to bring them into reactive association for a sufficient time to cause to a photochemical reaction and to provide a photographic image, said photochemical delivery article consisting essentially of a nonporous substrate having disposed thereon a hydrogel containing one or more diffusible photochemicals, and a removable cover sheet on the opposite side of said hydrogel, and B) scanning the photographic image formed in step A to form density representative electronic signals.

* * * * *